US006102776A

United States Patent [19]

Boggs et al.

[11] Patent Number: 6,102,776

[45] Date of Patent: Aug. 15, 2000

[54] APPARATUS AND METHOD FOR CONTROLLING POLISHING OF INTEGRATED CIRCUIT SUBSTRATES

[75] Inventors: Karl E. Boggs, Poughkeepsie; Kenneth M. Davis, Newburgh; William F. Landers, Wappingers Falls, all of N.Y.; Robert M. Merkling, Jr., Danbury, Conn.; Michael L. Passow, Pleasant Valley; Jeremy K. Stephens, Ossining, both of N.Y.

[73] Assignee: International Business Machines Corporation, Armonk, N.Y.

[21] Appl. No.: 09/225,597

[22] Filed: Jan. 6, 1999

[51] Int. Cl.[7] ..... B24B 49/00; B24B 51/00

[52] U.S. Cl. ..... 451/8; 451/285; 451/288

[58] Field of Search ..... 451/41, 10, 11, 451/285, 287, 288, 8, 9

[56] References Cited

U.S. PATENT DOCUMENTS

| | | | |
|---|---|---|---|
| 4,793,895 | 12/1988 | Kaanta et al. | 156/627 |
| 5,081,421 | 1/1992 | Miller et al. | 324/671 |
| 5,234,868 | 8/1993 | Cote | 437/235 |
| 5,433,650 | 7/1995 | Winebarger | 451/6 |
| 5,433,651 | 7/1995 | Lustig et al. | 451/6 |
| 5,492,594 | 2/1996 | Burke et al. | 216/86 |
| 5,637,185 | 6/1997 | Murarka et al. | 438/5 |
| 5,660,672 | 8/1997 | Li et al. | 156/345 |
| 5,667,424 | 9/1997 | Pan | 451/6 |

*Primary Examiner*—Rodney A. Butler

*Attorney, Agent, or Firm*—Pollock Vande Sande & Amernick

[57] ABSTRACT

A system for polishing a surface. The surface is positioned in contact with a rotating table having a polishing slurry or compound applied to a table surface. The pattern formed in the polishing compound as the table is rotated is monitored, and when the pattern dimensions reach a predetermined size, indicating a polished end point, the polisher ends polishing.

17 Claims, 4 Drawing Sheets

APPARATUS AND METHOD FOR CONTROLLING POLISHING OF INTEGRATED CIRCUIT SUBSTRATES

BACKGROUND OF THE INVENTION

The present invention relates to the manufacture of integrated circuits. Specifically, a method and apparatus are described for accurately determining the end point of a polishing operation.

In the manufacture of integrated circuit substrates, chemical-mechanical polishing processes are carried out on the substrate to planarize various layers which have been deposited on the substrate. The process of polishing the surface of a semiconductor requires that an accurate determination be made as to when polishing is to cease. Various techniques have been developed to detect the required polishing end point, including the measurement of the friction between a substrate and a polishing pad, sensed by monitoring the changing motor torque requirements, as well as measuring the temperature of the polishing pad surface, optical inspection of the wafer surface, measurement of surface conductivity, etc.

As the feature dimensions of an integrated circuit are reduced, it becomes more critical to be able to precisely determine end point, and to avoid either underpolishing or overpolishing the substrate. If substrates are underpolished, electrical defects such as conductor shorting and open contacts may result increasing the amount of rework necessary. Overpolishing of substrates impacts on electrical performance, and results in lower yields when layer thicknesses are reduced below specification.

The ability to precisely determine polishing end point, and controlling polishing in response to an accurately detected end point reduces the problems associated with the overpolishing and underpolishing of substrates.

SUMMARY OF THE INVENTION

The present invention represents an improvement over prior art processes for measuring the end point in a substrate polishing operation by accurately monitoring the amount of polishing which has taken place in a chemical-mechanical polishing process. A substrate is supported on a rotatable table, facing a motor driven polishing pad. The polishing pad receives a slurry of polishing material and a surface of the substrate is brought into contact with the slurry on the rotating pad. During polishing the chemistry and physical properties of the polishing slurry vary, and by accurately monitoring the slurry wetting and flow properties, a precise end point may be determined representing the desired degree of polishing.

In a first embodiment of the invention, the flow pattern of the slurry is monitored as an indication of the degree of polish which has occurred on the substrate. The trailing portion of the slurry pattern, or "wake", formed by the slurry represents one measure of polishing which may be used to determine the end point. Optically sensing the boundaries of the wake permits generation of a control signal for ending polishing at a boundary width representing the time of the desired end point.

The condition of the slurry produced during polishing may be monitored in other ways, such as by sensing the surface reflectivity of the slurry, the scattering profile of the slurry, the surface tension of the slurry, or the various patterns formed in the slurry as polishing progresses. Any one of these conditions may produce a determination of the level of polishing which has taken place forming a basis for determining the end point.

DETAILED DESCRIPTION OF THE PREFERRED EMBODIMENT

Figure 1:
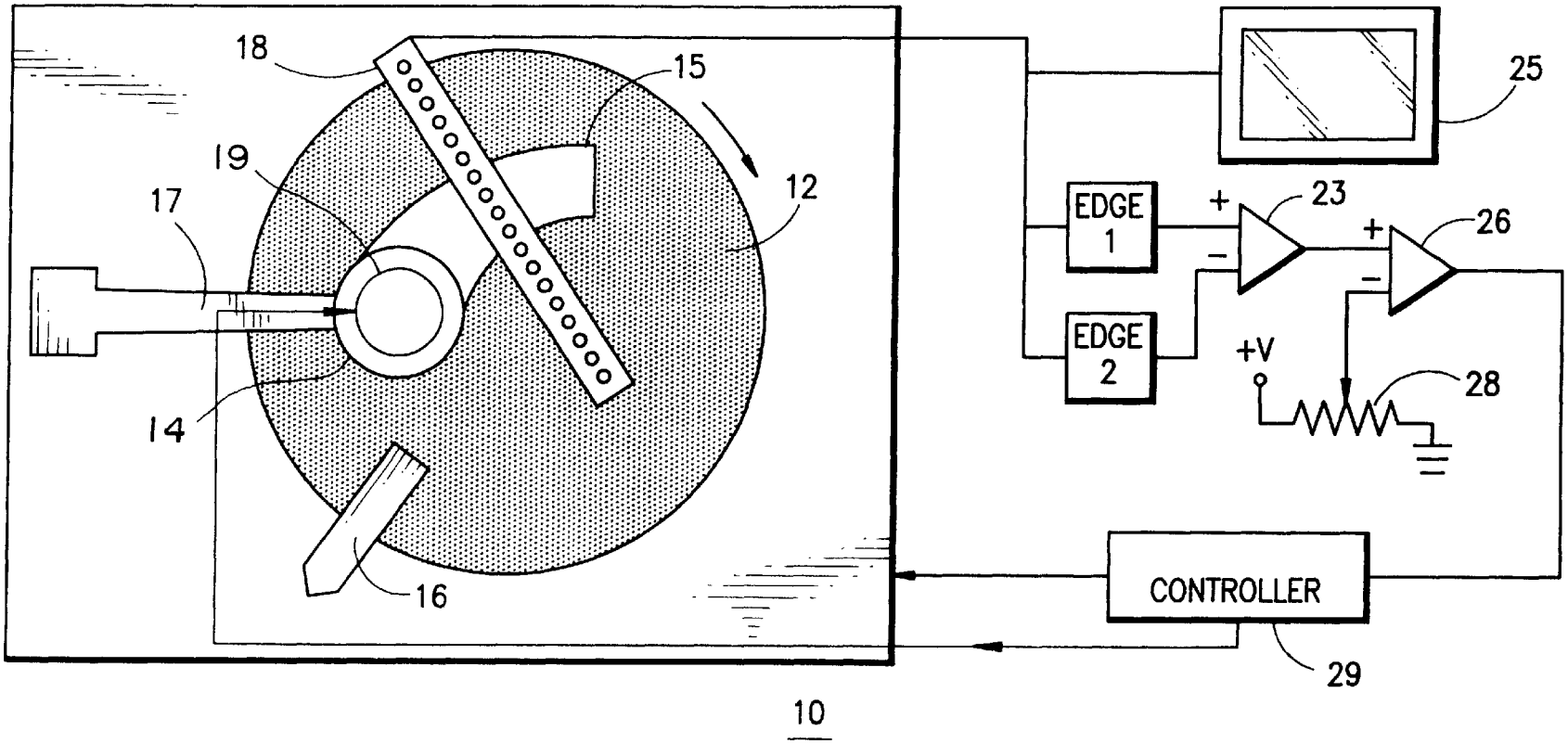
FIG. 1 illustrates a top view of a polishing apparatus which carries out the method in accordance with the a preferred embodiment of invention, illustrating the wake created in the chemical-mechanical polishing compound.
Figure 2:
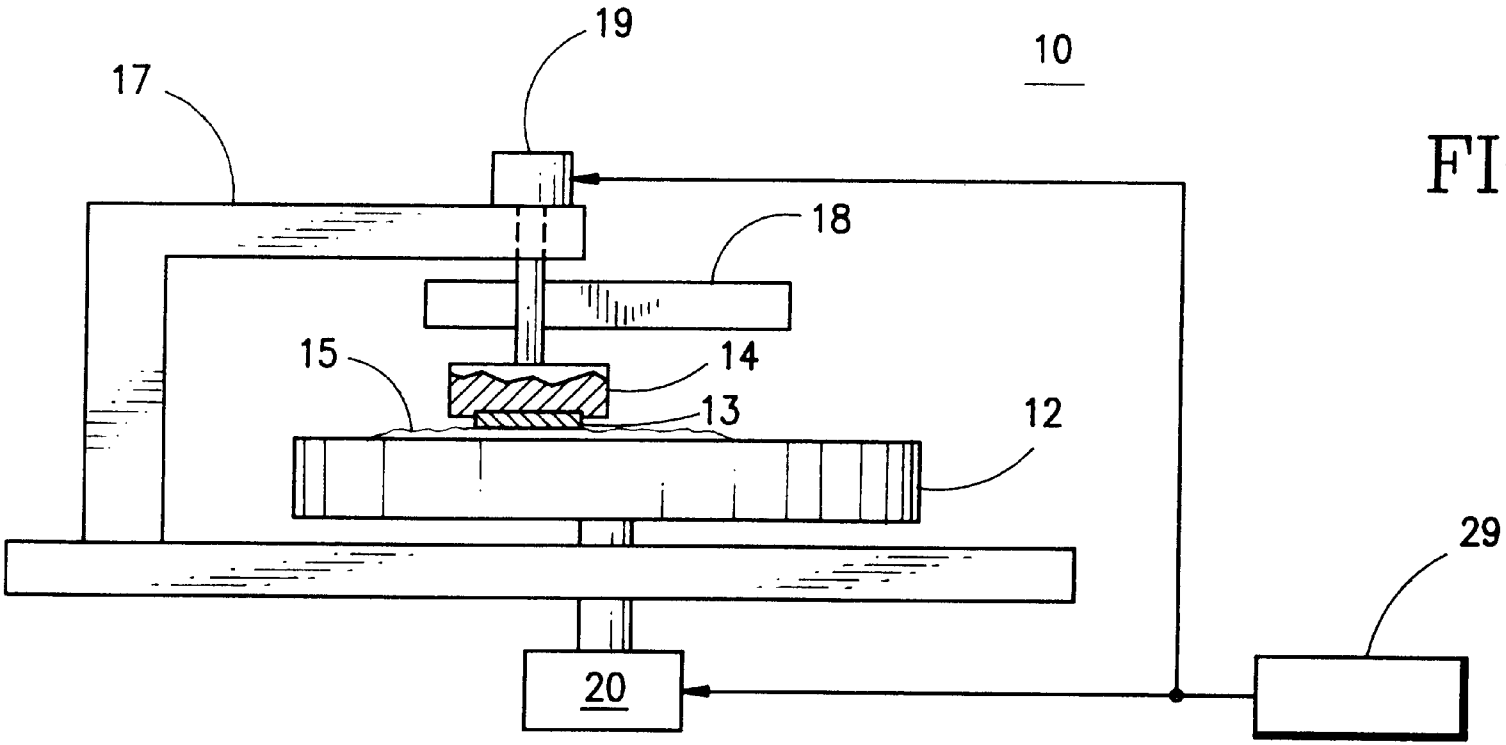
FIG. 2 is a side view of the apparatus of FIG. 1.

Referring now to FIG. 1, there is shown an apparatus for polishing a substrate 13. The substrate 13 is supported for rotation on a pickup head 14. Pickup head 14 supported on electro-mechanical actuator 19 which is in turn supported on arm 17 places one surface of the substrate 13 in contact with a polishing compound 15 which may be a chemical-mechanical slurry material deposited on the surface of rotating pad 12. The electro-mechanical actuator 19 applies a force to the substrate 13 to maintain the substrate 13 in contact with the polishing compound 15 on pad 12. During rotation of the pad 12, the chemical-mechanical slurry 15 polishes the surface of substrate 13 when motor 20 rotates pad 12. The chemical-mechanical slurry is deposited from a source 16 which is connected to a reservoir of the chemical-mechanical slurry material. The rotation of pad 12 creates a pattern of slurry material shown in FIG. 1, which can generally be described as a wake trailing the substrate 13.

As the polishing process continues, the patterns formed in the wake material 15 change. One indication of the degree of polishing obtained on the substrate 13 is the width of the wake created in the chemical-mechanical slurry 15. An array of optical sensors 18 disposed over the pad 12 is capable of sensing the width of the wake. The width of the wake can be compared to a reference width, representing the end point for the polishing process.

The width of the wake of the chemical-mechanical slurry 15 will decrease rapidly at the end point as the polishing process continues. Electronic circuitry 21 monitors the width of the wake as an indication of the degree of polishing obtained. The array of sensors 18 sense the reflectivity of the pad surface 12 along the length of the array to locate first and second edges of the wake created in the slurry 15. A first edge detector 22 provides a voltage representing the position of one edge of the wake to a comparator circuit 23, and a second edge detector 24 determines from the reflectivity observed along the array 18 the position of a second edge of the wake.

The total width of the wake may be obtained by comparator 26 and used as a quantity representing the degree of polish on the surface of substrate 13. The width may be compared with a reference width 28, represented as a voltage on a reference input of comparator 26. When the reference width and measured width are equal, a control signal may be generated for ending the polishing process by changing the rotational speed of motor 20 and pad 12, or reducing the contact force between substrate 13 and the slurry covered pad 12. The control signal received by motor controller 29 identifying the end point may be used to slow the rotation of motor 20 and/or adjust the force applied by actuator 19 to the substrate to reduce the contact force between the substrate 13 and polishing pad 12 thus ending the polishing process. A monitor 25 is also provided to permit the operator's observation of the width of the wake during polishing.

Figures 3, 5:
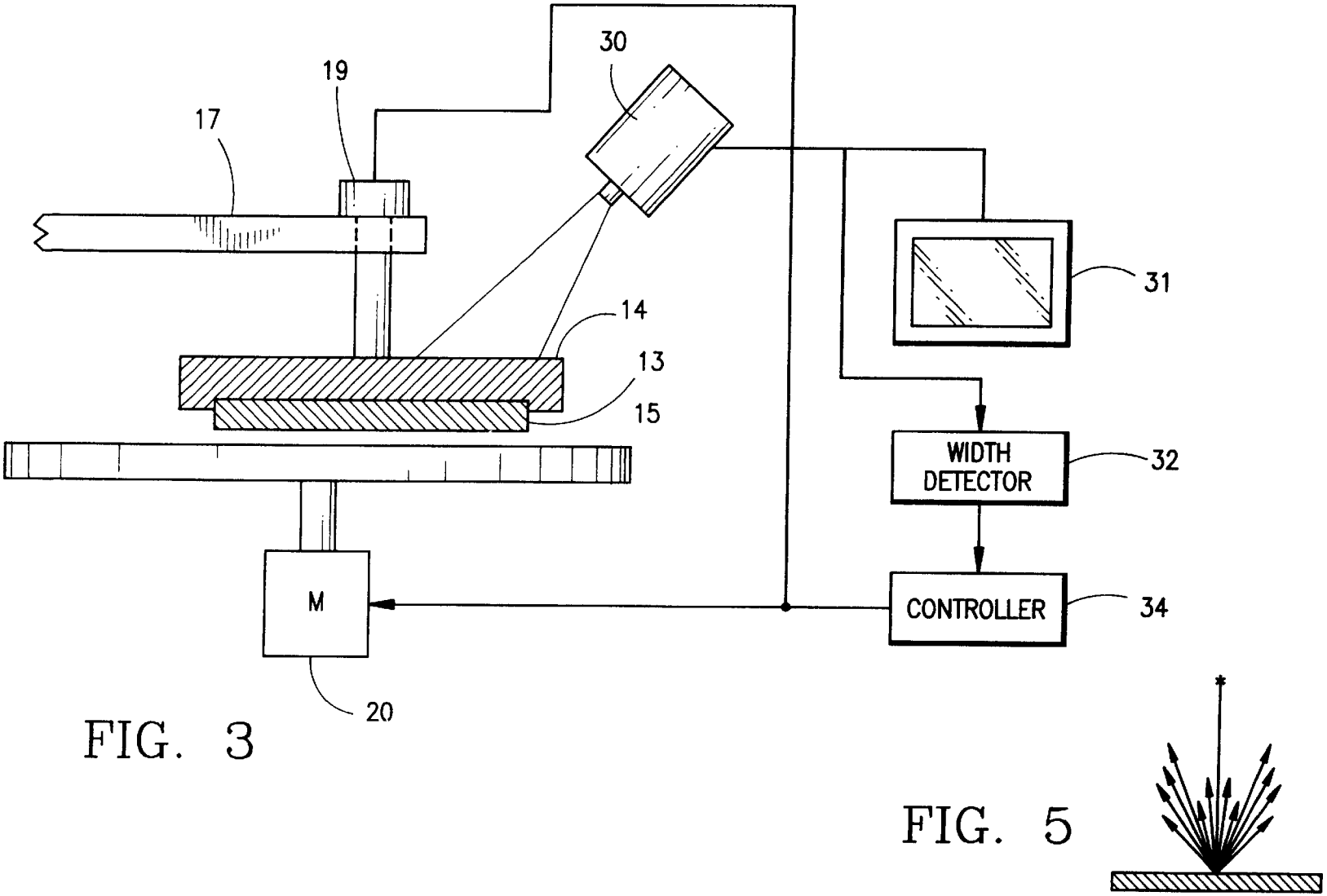
FIG. 3 represents another embodiment of the invention which uses an image vision system to monitor the slurry wake.
FIG. 5 illustrates the reflected light dispersion creating a time varying signal which changes as the slurry surface changes.

Monitoring the slurry 15 may also be accomplished using an array of elements located in the wake region which can measure the light scattering intensity profile over the surface of the pad 12. The array 18 includes light sources, such as laser diodes, and a set of photosensors which measures the signal at different scattering angles as shown in FIG. 5. The output of the photosensors are used to determine the edges of the wake, which as in the embodiment of FIG. 1, could be used to observe the wake on a display 20, or as an end point control signal for a motor controller 29.

Additionally, as another way for monitoring the slurry flow patterns, an optical sensor array comprising proximity sensors may be located over the slurry wake, instead of the sensor array of FIG. 1 which monitors reflectivity. The proximity sensors provide signals along the length of the array which represent the relative distance of the underlying slurry 15 to the array which can be related to the relative thickness of slurry 15. The relative thickness of the slurry 15 may then be used to locate first and second edges of the wake, which in turn identifies the width of the wake.

In yet another way for monitoring the slurry flow pattern width, two or more probes may be implemented in contact with pad 12 to measure the conductivity of the slurry pattern which changes as the width of the pattern changes.

In still another approach for monitoring the progress of surface polishing, FIG. 3 represents a system which monitors the slurry wake 15 using a vision system. The vision system comprises a camera 30, positioned to observe the slurry 15 on the surface of pad 12. A monitor 31 may be used by the operator to monitor the condition of the pad 12, through a visual inspection of the changes in surface conditions on pad 12.

The vision system of FIG. 3 may also be equipped with edge detector 32, which by comparing the grey scale level from a scanned image produced by camera 30 with a reference grey scale, determines the edges of the wake.

A controller 34 operates in response to a signal representing the width of the wake, generating a stop signal for motor 20 to inhibit further polishing of the substrate 13.

Figure 4B:
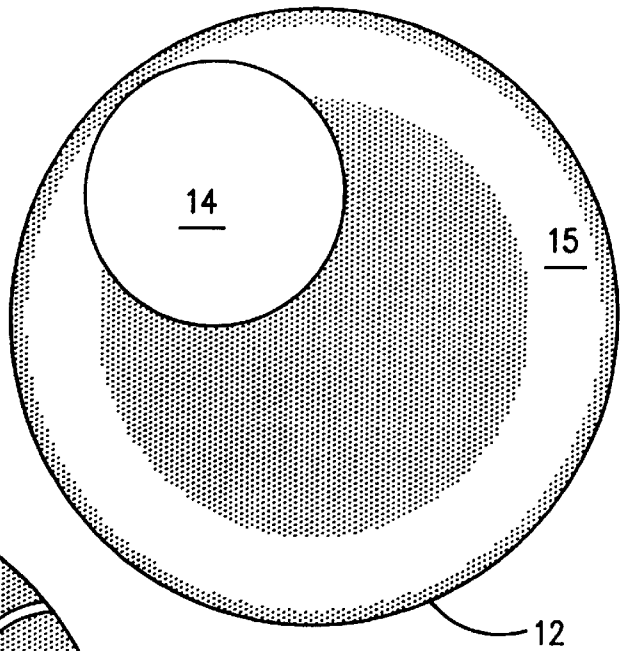
FIG. 4B shows a late polishing compound pattern.
Figure 4A:
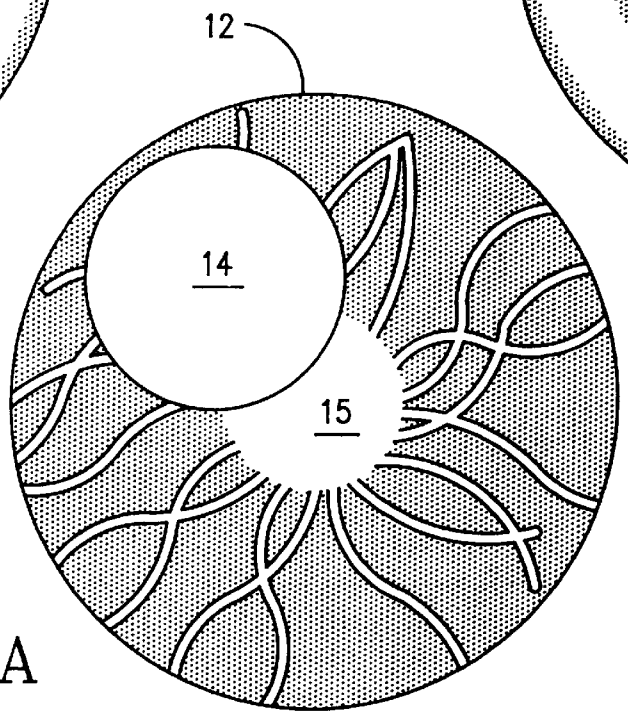
FIG. 4A shows the resulting polishing compound pattern which initially occurs during polishing.
Figure 4C:
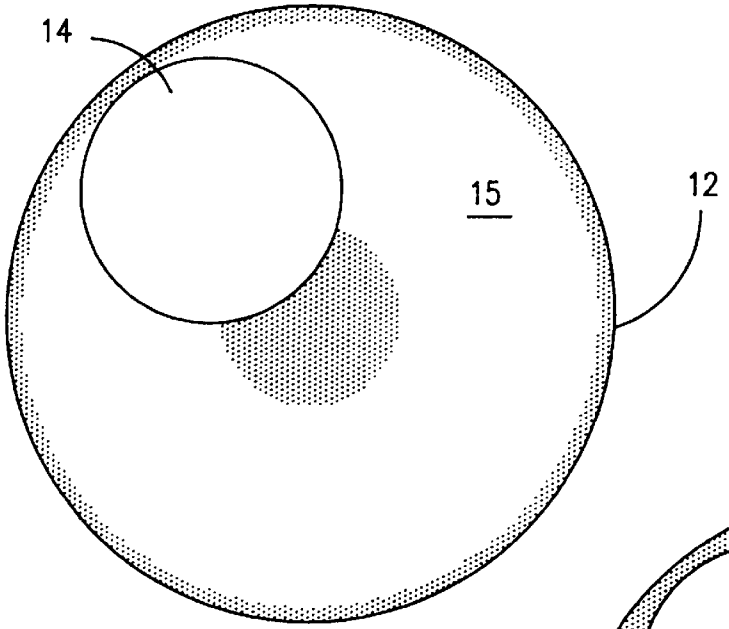
FIG. 4C shows a compound pattern formed after extensive polishing.

The vision system of FIG. 3 permits the constant monitoring of the conditions of pad 12, and the slurry 15. During a pad break-in process, various patterns in slurry 15 can be observed that include gaps and holes, as shown in FIG. 4A, which eventually become a continuous film layer as shown in FIGS. 4B and 4C, depending on the length of time the polish process continues. The condition of the pad 12 may be monitored to accurately control the pad conditioning process.

As a further embodiment of the invention, the vision system of FIG. 3 may be used to observe the surface tension of a fixed volume of slurry droplets which are deposited on the pad 12. By observing the size and spreading velocity of the droplets, an indication of a polishing end point may be determined.

Thus, there is shown that the control over polishing, and particularly end point determination may be effected by monitoring the slurry pattern 15.

Those skilled in the art will recognize the other embodiments of the invention described more particularly by the claims which follow.

The foregoing description illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. An apparatus for controlling polishing of a component surface comprising:

a rotatable table having a polishing compound disposed on a surface thereof;

a component carrier for supporting said component surface in contact with said polishing compound;

an array of sensors positioned above said table surface for detecting a dimension of a wake formed in said polishing compound; and a controller for controlling polishing, said controller connected to said array of sensors to determine from signals of said sensors a dimension of a trailing wake created in said polishing compound, and said controller ending polishing when said determined dimension is equal to a reference dimension.

2. The apparatus according to claim 1 wherein said array of sensors comprise an linear array of photo sensors positioned above said wake which monitors the amount of light reflected from said wake.

3. The apparatus according to claim 1 wherein said array of sensors are proximity sensors for monitoring said wake thickness along the width of said wake.

4. The apparatus according to claim 2 further comprising an array of light sources to produce scattered light from said wake which is sensed by said photo sensors.

5. In a system for precision polishing a surface wherein a surface to be polished is supported for contact with a rotating table having a polishing compound applied to the table surface, a method for determining a polishing end point comprising:

monitoring a wake edge pattern created in said polishing compound as said table is rotated; and ending polishing of said surface when said pattern indicates that said component surface has reached a polish endpoint.

6. The method according to claim 5 wherein said polishing is ended when the width of said pattern is reduced to a predetermined dimension.

7. The method according to claim 5 wherein said step of monitoring comprises optically detecting boundaries of said pattern.

8. The method according to claim 5 wherein said step of monitoring comprises monitoring the surface reflectivity of said compound which covers said table.

9. The method according to claim 5 wherein said step of monitoring displays said pattern on a electronic display for visual observation.

10. The method according to claim 7 wherein said boundaries are detected with an array of sensors disposed over said table.

11. The method according to claim 8 wherein said step of monitoring determines the light scattering profile of said compound which covers said table.

12. The method according to claim 9 wherein said step of monitoring includes visually determining the velocity of droplets deposited on said slurry pattern.

13. An apparatus for controlling polishing of a component surface comprising:

a rotatable table having a surface having a polishing compound disposed thereon;

a component carrier for supporting said component surface in contact with said polishing compound;

an array of sensors positioned above said table surface for detecting the wake edge pattern formed in said polishing compound during rotation of said rotatable table; and a controller for controlling polishing, said controller connected to said array of sensors to determine from signals of said sensors a wake edge pattern created in said polishing compound, and to end polishing of said component surface when said determined pattern identifies a predetermined degree of polishing of said surface.

14. The apparatus according to claim 13 wherein said array of sensors comprises proximity sensors which determine the depth of said polishing compound on said surface.

15. The apparatus of claim 13 wherein said controller determines the width of a portion of said pattern as an indication of a degree of polishing of said component surface.

16. The apparatus of claim 13 further comprising a monitor connected to said controller for monitoring said portion of said pattern.

17. The apparatus of claim 15 wherein said portion of said pattern is a trailing wake of said polishing compound created during polishing said component surface.

* * * * *